US006181054B1

(12) United States Patent
Levin et al.

(10) Patent No.: US 6,181,054 B1
(45) Date of Patent: Jan. 30, 2001

(54) LAMP BULB WITH INTEGRAL REFLECTOR

(75) Inventors: Izrail Levin, Silver Spring; Bruce Shanks, Gaithersburg; Thomas L. Sumner, Wheaton, all of MD (US)

(73) Assignee: Fusion Lighting, Inc., Rockville, MD (US)

( * ) Notice: Under 35 U.S.C. 154(b), the term of this patent shall be extended for 0 days.

(21) Appl. No.: 09/380,832

(22) PCT Filed: May 5, 1998

(86) PCT No.: PCT/US98/08957

§ 371 Date: Sep. 10, 1999

§ 102(e) Date: Sep. 10, 1999

(87) PCT Pub. No.: WO98/53475

PCT Pub. Date: Nov. 26, 1998

Related U.S. Application Data

(60) Provisional application No. 60/047,093, filed on May 20, 1997.

(51) Int. Cl.[7] ..... H01J 1/02; F21V 7/00

(52) U.S. Cl. ..... 313/113; 313/634; 313/573

(58) Field of Search ..... 313/113, 633, 313/573, 638, 167, 493, 634; 315/248, 344

(56) References Cited

U.S. PATENT DOCUMENTS

| | | | |
|---|---|---|---|
| 4,924,141 | 5/1990 | Taubner et al. | 313/488 |
| 4,950,059 | 8/1990 | Roberts | 350/345 |
| 5,493,170 | 2/1996 | Sheppard | 313/113 |
| 5,500,574 | 3/1996 | Popov, et al. | 315/248 |
| 5,734,221 | 3/1998 | Van Os | 313/113 |
| 5,949,180 | 9/1999 | Walker | 313/113 |
| 6,005,332 | 12/1999 | Mercer | 313/113 |

FOREIGN PATENT DOCUMENTS

| | | | |
|---|---|---|---|
| 0671758A2 | 9/1995 | (EP) | H01J/65/04 |
| 0871205 A1 | 10/1998 | (EP) | H01J/65/04 |
| WO 98/53475 | 11/1998 | (WO) | H01J/1/02 |

*Primary Examiner*—Ashok Patel
(74) *Attorney, Agent, or Firm*—Paul E. Steiner

(57) ABSTRACT

An improved electrodeless discharge lamp bulb includes an integral ceramic reflector as a portion of the bulb envelope. The bulb envelope further includes two pieces, a reflector portion or segment is cast quartz ceramic and a light transmissive portion is a clear fused silica. In one embodiment, the cast quartz ceramic segment includes heat sink fins or stubs providing an increased outside surface area to dissipate internal heat. In another embodiment, the quartz ceramic segment includes an outside surface fused to eliminate gas permeation by polishing.

20 Claims, 5 Drawing Sheets

LAMP BULB WITH INTEGRAL REFLECTOR

CROSS REFERENCE TO RELATED APPLICATIONS

This application is based on and claims the benefit of priority of U.S. provisional application No. 60/047,093, filed May 20, 1997.

This invention was made with Government Support under Contract No. DE-FG01-95EE23796 awarded by the Department of Energy. The Government has certain rights in this invention.

BACKGROUND OF THE INVENTION

1. Technical Field

The present invention pertains to improvements for envelopes containing a fill for use in electrodeless lamps and has particular, although not limited, utility in lamps of the type disclosed in U.S. Pat. No. 5,404,076 and PCT International Publication No. WO 92/08240, the disclosures of which are expressly incorporated by reference herein in their entirety.

2. Discussion of Related Art

Electrodeless lamps of the type with which the present invention is concerned are comprised of a light transmissive bulb having an envelope containing a plasma-forming medium. A bulb is an envelope usually mounted on an elongate, radially projecting supporting stem. A microwave or radio frequency (RF) energy source has its output energy coupled through the envelope via a coupling arrangement to excite a plasma, resulting in a light discharge. The energy coupling arrangement customarily includes a microwave cavity to which microwave energy is coupled, and the bulb is mounted inside the cavity. Alternatively, the energy may be coupled to the fill through an inductive arrangement (e.g. an excitation coil surrounding the bulb) or a capacitive arrangement (e.g. a bulb between two electrodes). Electrodeless lamps may include an internal reflector or may be reflectorless, the latter requiring a separate light reflector to direct light emissions. A separate reflector is not readily inserted within the cavity since the cavity customarily includes a first solid conductive structure at one end, usually a cylindrical wall, joined to a second cylindrical structure formed of a mesh (e.g., tungsten mesh), such that microwave energy is contained within the cavity but light is transmitted outwardly. A separate reflector customarily has an axis of symmetry approximately coincident with the axis of the cavity and surrounds the cavity. The surface of the reflector may follow a simple geometric contour such as an ellipsoid or paraboloid and may be comprised of a plurality of annular facets, each sized and oriented to direct reflected light in a desired direction. A bulb is located along the axis of the cavity within the mesh structure and includes an envelope portion and a stem. The stem may also be located along the axis of the cavity or may be positioned at an angle with respect to the axis. The stem may be fixed (e.g. fastened to the first solid structure) or may be secured to a motor shaft for rotation of the bulb. If the envelope is essentially spherical and the light source is energized by microwaves, the resulting light produced is emitted with significant power in all directions. However, only a portion of the solid angle about the envelope corresponds to the mesh and substantial light is blocked by solid structure and not received by the reflector. The blocked portion of the solid angle about the envelope corresponds to the solid structure of the cavity and the end wall of the cavity (e.g. the wall with the coupling slot) and therefore light directed toward the blocked portion is occluded and lost.

In order to more efficiently direct the light outwardly and away from the coupling wave guide structure, various techniques have been suggested. For example, U.S. Pat. No. 5,334,913 (Ury et al) discloses a supplemental non-conductive optical reflector located within the cavity. Although reflectors disposed apart from the envelope but within the cavity can be effective, they consume space and add to the cost of the overall lamp.

Another problem encountered using spherical glass envelope structures is that significant thermal stresses are created in the envelope wall. In particular, internal heat from the plasma necessitates use of cooling fans to control the temperature of the envelope wall. In prior art lamps, rotation of the bulb about its support stem axis is commonly done for a number of reasons, one of which is to evenly distribute flow of cooling air over the envelope wall. Use of a separate non-conductive internal optical reflector has, therefore, presented additional problems in that special conduits for jets of cooling air must be routed around the internal reflector.

OBJECTS AND SUMMARY OF THE INVENTION

It is an object of the present invention to overcome the aforesaid problems of the prior art.

It is another object of the present invention to provide an envelope with an integral reflector.

Another object of the present invention is to provide a method for joining a ceramic reflector to a glass segment, thereby making an envelope with an integral reflector.

The aforesaid objects are achieved individually and in combination, and it is not intended that the present invention be construed as requiring two or more of the objects to be combined unless expressly required by the claims attached hereto.

As part of the present invention, it has been discovered that an improved electrodeless discharge lamp bulb can be obtained by providing an integral ceramic reflector as a portion of the envelope. The reflector increases candle power along the axis of the bulb away from the lamp and reduces the light energy directed behind the bulb. In accordance with the present invention, a bulb envelope is fabricated from two pressure sealed portions or segments. The reflector portion may be, for example, cast quartz ceramic and the light transmissive portion may be, for example, clear fused silica. By using the manufacturing method of the present invention, a plurality of bulb shapes and designs are made possible. In one embodiment, the cast quartz ceramic portion or segment includes heat sink fins, providing an increased outside surface area to dissipate internal envelope heat.

In the method of the present invention, the quartz ceramic segment has an outside surface that is fused using a fire polishing technique to eliminate fill gas permeation. In order to prevent cracking of the ceramic during fire polishing along one surface, the opposing surface is preferably cooled with a gas jet.

The light transmissive portion and the reflective ceramic portion of the bulb envelope are fused together using a gas torch or a laser. Preferably, fused silica material is added to the fusion zone. The fusion zone is defined as having a radial thickness of 1 to 1.5 times the wall thickness of the clear quartz glass used in the light transmissive segment. The size of a high temperature hot zone is controlled to be within a range of at least about 2 times the wall thickness of the clear quartz glass.

With the bulb of the present invention, a significant improvement in light directivity is obtained. As compared to a spherical envelope of clear quartz glass, a spherical envelope of the same radius built in accordance with the present invention includes a hemispherical ceramic reflector mated to a hemispherical light transmissive segment and emits light with an increase of about 50% in peak light intensity along the 90° angle corresponding to the bulb axis.

The above and still further objects, features and advantages of the present invention will become apparent upon consideration of the following detailed description of a specific embodiment thereof, particularly when taken in conjunction with the accompanying drawings, wherein like reference numerals on the various figures are utilized to designate like components.

DESCRIPTION

Figure 1:
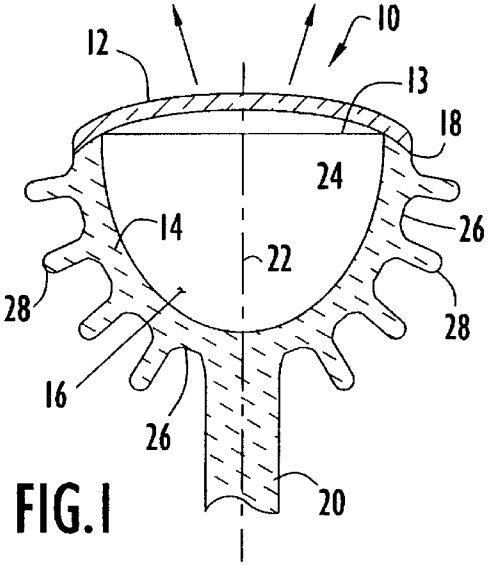
FIG. 1 is a cross-sectional view, in elevation, of an electrodeless lamp bulb having an integral ceramic reflector and heat sink elements, in accordance with the present invention.

According to a first embodiment of the present invention, there is illustrated in FIG. 1 an electrodeless lamp envelope 10 comprising a light transmissive segment 12 in the form of a minor portion of a sphere, and bowl-shaped ceramic reflective segment 14 having a circular open end 13 fused together in pressure sealed relation to enclose an inside volume 16. The reflective segment 14 has a generally parabolic cross-section. In this embodiment, the imaginary sphere of which segment 12 is a minor portion has a diameter larger than the diameter of the circular open end 13 of reflective segment 14. The clear fused silica or quartz light transmissive segment 12 is fused to the ceramic reflective segment 14 at circular open end 13 thereby forming a seam or joint 18. In the embodiment of FIG. 1, ceramic reflective segment 14 is integrally affixed to and supported by an elongate support stem or rod 20 projecting radially outwardly from segment 14 along a central axis 22. Ceramic reflective segment 14 also has an inside surface 24 facing toward the enclosed inside volume 16 opposing an outside surface 26 having a plurality of heat sink elements 28 formed or disposed thereupon. As illustrated in FIG. 1, heat sink elements 28 can be radially arrayed continuous fins or outwardly projecting stubs. The heat sink elements 28 effectively increase the surface area of the ceramic reflective segment 14 outside surface 26, thereby enhancing heat dissipation from envelope 10.

In the preferred embodiment, ceramic reflective segment 14 is fabricated from fused quartz ceramic, and light transmissive segment 12 is preferably clear fused silica or clear quartz glass.

Figure 2:
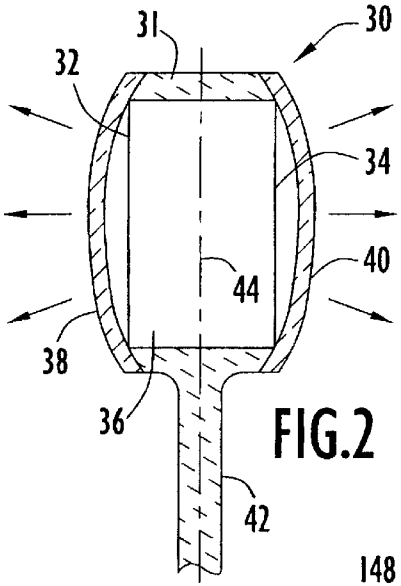
FIG. 2 is a cross-sectional view of an embodiment of the bulb of the present invention having an annular integral ceramic reflector.

Turning now to the embodiment illustrated in FIG. 2, an envelope 30 includes a hollow, generally right cylindrical ceramic reflective segment 31 having a first open end 32 opposite a second open end 34 and an open space 36 therebetween. A first light transmissive minor spherical segment 38 is affixed to and seals first open end 32; similarly, a second light transmissive minor spherical segment 40 is affixed to and seals second open end 34, thereby defining an enclosed, pressure sealed inside envelope volume including the open space 36 within cylindrical reflective segment 31. An elongate support stem or rod 42 extends radially outward from a side wall of cylindrical reflective segment 31. Stem 42 has a central axis 44 oriented perpendicular to the axis of cylindrical segment 31.

Figure 3:
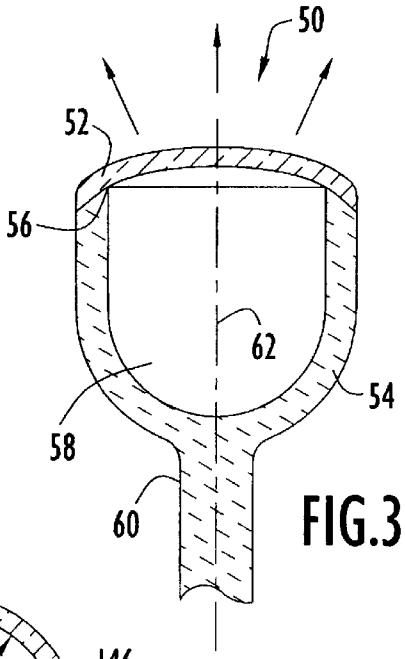
FIG. 3 is a cross-sectional view, in elevation, of another embodiment of the bulb of the present invention.
Figure 4:
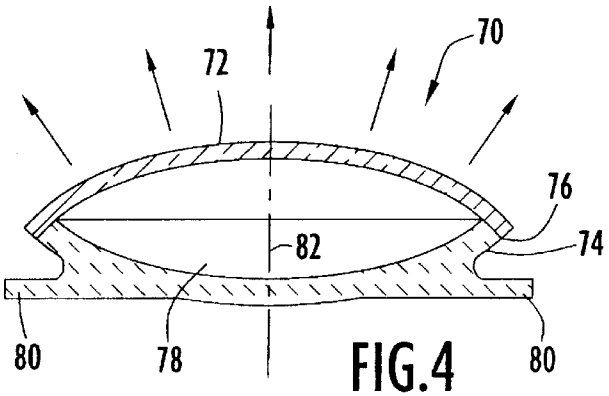
FIG. 4 is a cross-sectional view, in elevation, of an alternative embodiment of the bulb of the present invention.
Figure 5:
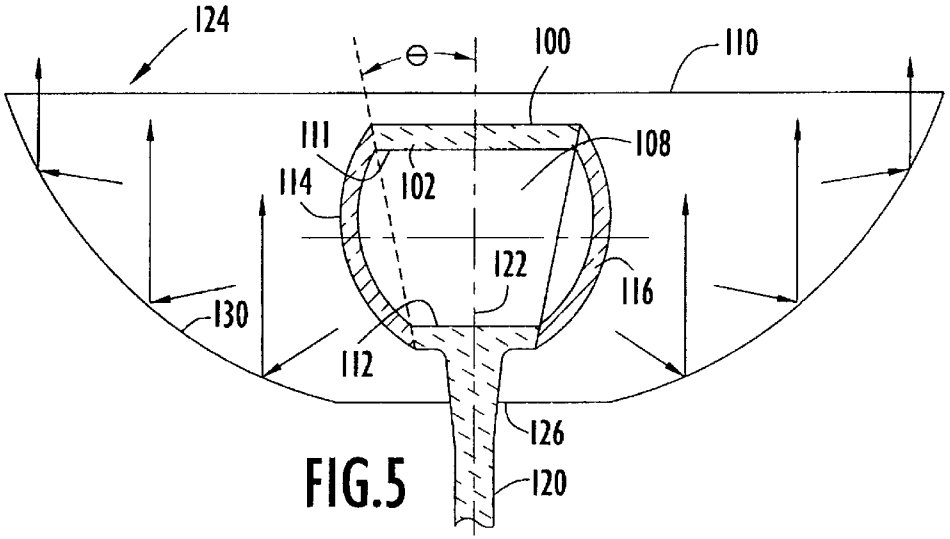
FIG. 5 is a diagrammatic illustration and partial cross-section of the bulb of the present invention in conjunction with an external reflector.
Figure 5B:
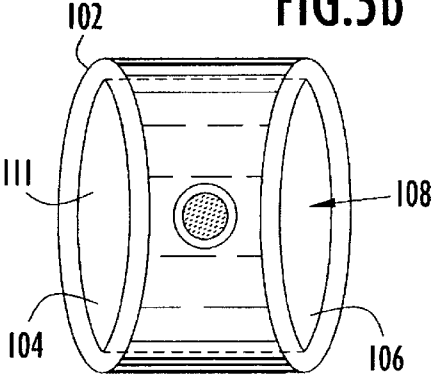
FIG. 5B is a bottom view of the reflector segment of the bulb of FIG. 5.
Figure 5C:
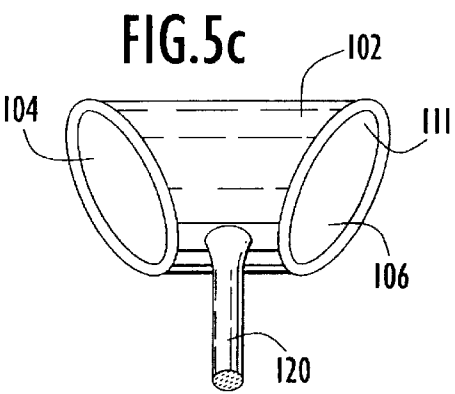
FIG. 5C is a perspective view of the reflector segment of the bulb of FIG. 5.
Figure 5A:
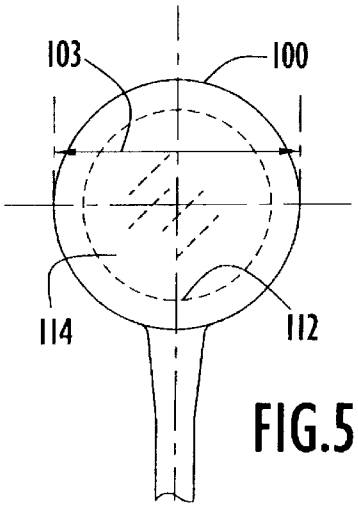
FIG. 5A is a side view of the bulb of FIG. 5.

In another embodiment illustrated in FIG. 3, an envelope 50 comprises a minor spherical light transmissive segment 52 and a bowl-shaped ceramic reflective segment 54 fused together at a joint or seam 56 to enclose an envelope inside volume 58. Ceramic reflective segment 54 has a generally U-shaped longitudinal cross section and includes an integral elongate support rod 60 having a central axis 62 disposed coaxially with the longitudinal axis of reflective segment 54. Referring to FIG. 4, yet another embodiment is illustrated having a generally oblate, pillow-shaped envelope 70 with a light transmissive minor spherical segment 72 and a bowl-shaped ceramic reflective segment 74 joined thereto at a seam or joint 76 to enclose an interior volume 78. The bowl-shaped portion of ceramic reflective segment 74 is a minor portion of a sphere and is integrally molded with support flange members 80 projecting radially from and perpendicular to center line 82.

Turning now to FIGS. 5, 5A, 5B and 5C, there is illustrated an envelope 100 disposed within an external reflector 110. Envelope 100 includes a truncated cylindrical ceramic reflective segment 102 having a selected outside diameter 103, and a first angled open end 104 opposite a second angled open end 106, defining an open space 108 therebetween. Open ends 104, 106 are truncated at a selected angle θ so that the cylindrical ceramic reflective segment does not form a right cylinder, thereby providing an upper inner reflective surface portion 111 having a longer longitudinal extent than an opposing lower inner reflective surface portion 112. As a result, upper inner reflective surface portion 111 extends beyond lower inner reflective surface portion 112, as shown in bottom view FIG. 5B and perspective view FIG. 5C. A first minor spherical light transmissive segment 114 is affixed to and seals first open end 104; similarly, a second minor spherical light transmissive segment 116 is affixed to and seals second open end 106, thereby defining an enclosed, pressure sealed inside envelope volume including the open space 108. An elongate support stem or rod 120 having a central axis 122 extends radially from a side wall of cylindrical reflective segment 102 and perpendicularly to the central axis of cylindrical segment 102, at a point on the side wall nearest lower inner reflective surface portion 112.

External reflector 110 has a truncated parabolic cross section and an axis of symmetry approximately coincident with central axis 122, a large open end 124 with a width of approximately 3 to 5 times the diameter 103 of cylindrical segment 102, and a smaller preferably closed truncated end 126, preferably affixed to bulb support stem 120. In the embodiment illustrated in FIG.5, the external reflector interior reflective surface 130 is angled such that light reflected from the envelope upper inner surface portion 111 and light incident from the envelope enclosed volume is directed toward the external reflector interior surface 130 and subsequently reflected outwardly through reflector open end 124 in a direction parallel with central axis 122, presuming that envelope 100 is positioned at the focal point of the parabola. Of course, the external reflector 110 may take other shapes depending on the desired optics. For example, if the external reflector 110 has a truncated ellipsoidal cross section and the envelope 100 is positioned at the first focal point of the ellipse, the light will be reflected toward the second focal point of the ellipse.

Figure 6:
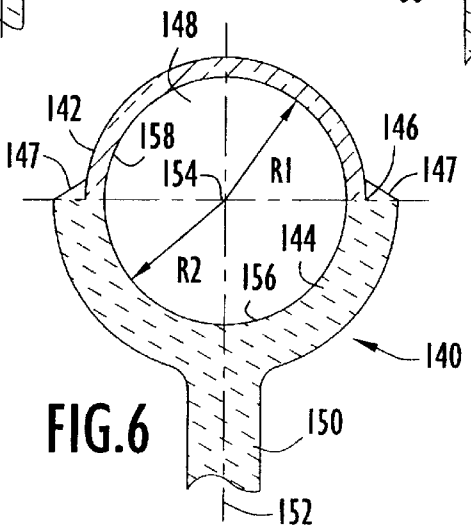
FIG. 6 is a cross-sectional view, in elevation, of a spherical bulb with integral reflector.

Turning now to FIG. 6, there is illustrated a spherical envelope 140 comprising a light transmissive substantially hemispherical segment 142 and a mating ceramic light reflective substantially hemispherical segment 144 fused thereto at a circular, equatorial joint or seam 146, thereby enclosing a substantially spherical, pressure sealed inside volume 148. Reflective ceramic segment 144 includes an integral and elongate axial support rod 150, of circular cross section, radially projecting therefrom and having a central axis 152 intersecting a bulb center reference point 154. The outside diameter and thickness of first segment 142 is less than the outside diameter and thickness of second, reflective segment 144, and an angled bead of fused silica 147 partly fills the shoulder created at the seam of the joined segments 142, 144. Spherical envelope 140 has a first inside surface 156 of reflective segment 144 and a second inside surface 158 of light transmissive segment 142. As illustrated in FIG. 6, the radius $R_1$ from center point 154 to second inside surface 158 is substantially equal to the radius $R_2$ from the center point to first inside surface 156, thereby defining spherical interior volume 148.

The enclosed, pressure sealed volumes inside the envelopes of FIGS. 1–6 may include elemental sulfur, a sulfur compound, elemental selenium or a selenium compound as a fill material. The fill may further include an inert gas such as, for example, argon or xenon. The fill is sealed in the envelopes by conventional means. Specifically, the light transmissive portions described above may include a hollow support tube through which the fill material is provided. The tube is subsequently tipped off, thereby sealing the fill material in the envelope.

The fill in envelopes 10, 30, 50, 70, 100 and 140 is typically present in amounts such that the fill pressure is at least one atmosphere or above at operating temperature and is preferably in the range of two to twenty atmospheres. The amplitude of the microwave energy fed to the cavity and thereby irradiating the envelopes may be such that the power density coupled to the fill is at least fifty watts per cc and may be as high as several hundred watts per cc (as disclosed in U.S. Pat. No. 5,404,076, noted above). Alternatively, the fill density and power density may be lower as described in PCT International Publication No. WP 95/10848 entitled "ELECTRODELESS LAMP WITH IMPROVED EFFICACY." In any event, the thickness, thermal tolerance and mechanical strength of materials utilized in the envelopes of FIGS. 1–6 are sufficient to withstand such fill pressures and power densities for extended periods of operational time. It is to be understood that the fill material has the characteristic of emitting light when excited by high frequency electrical energy. The emitted light may be in the ultraviolet, visible, and/or infrared range. High frequency electrical energy includes electromagnetic radiation in microwave or RF frequency bands, or other ranges of frequency used for producing light in electrodeless lamps.

Figure 7:
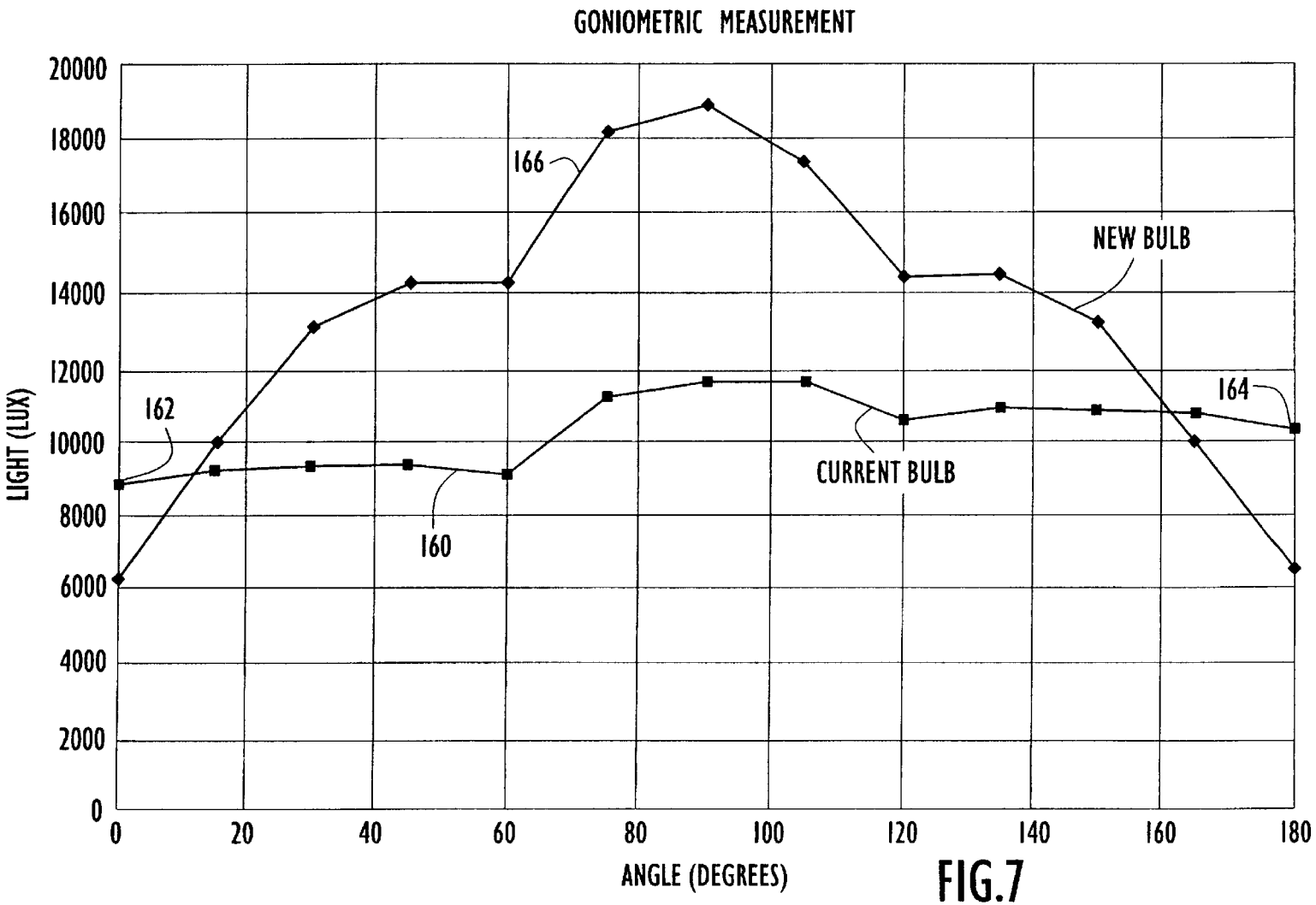
FIG. 7 is a plot of goniometric measurement results, for a prior art bulb and the bulb of the present invention, with light output plotted as a function of angle.

Turning now to FIG. 7, plotted results are illustrated for two series of goniometric measurements; a first curve 160 illustrates plotted goniometric measurements for a current (i.e., prior art) spherical, all glass, electrodeless lamp bulb and a second curve 166 illustrates plotted goniometric measurements for the bulb of the present invention (i.e., the bulb of FIG. 6 having a same interior volume and fill composition as the prior art bulb). Bulb light intensity (in lux) is expressed as a function of angle (in degrees). For purposes of nomenclature, and referring back to FIG. 6, a point at a fixed radial distance from bulb center reference point 154 is selected and central axis 152 is defined as being at a 90° angle. Therefore, a point perpendicular to the central axis 152 and at that same arbitrarily selected radial distance is defined (in FIG.7) as being at an angle of 0° (i.e., at point 162). A point opposite of the bulb but also perpendicular from the central axis 152 and at that same arbitrary radius is defined as being at an angle of 180° (or at point 164 in FIG. 7). Therefore, using the bulb of FIG.6 as a visual example, the measurements are taken at various angular displacements along a semicircular arc having the selected radius. The all glass bulb and the bulb of FIG. 6 are essentially spherical bulbs, but the bulb of FIG. 6 includes reflector segment 144 and therefore, as shown in the curve 166 in FIG.7, gives significantly more light output along central axis 152 (corresponding to the 90° angle in FIG. 7). Accordingly, it is illustrated that the bulb of the present invention, and in particular the bulb of FIG. 6, provides significantly more directivity and therefore provides a greater portion of its light in a useful direction. Specifically, the new bulb of FIG. 6 provides in excess of 18,000 lux on axis at the 90° angle whereas the all glass bulb of the prior art provides less than 12,000 lux at the 90° angular position.

Figure 8:
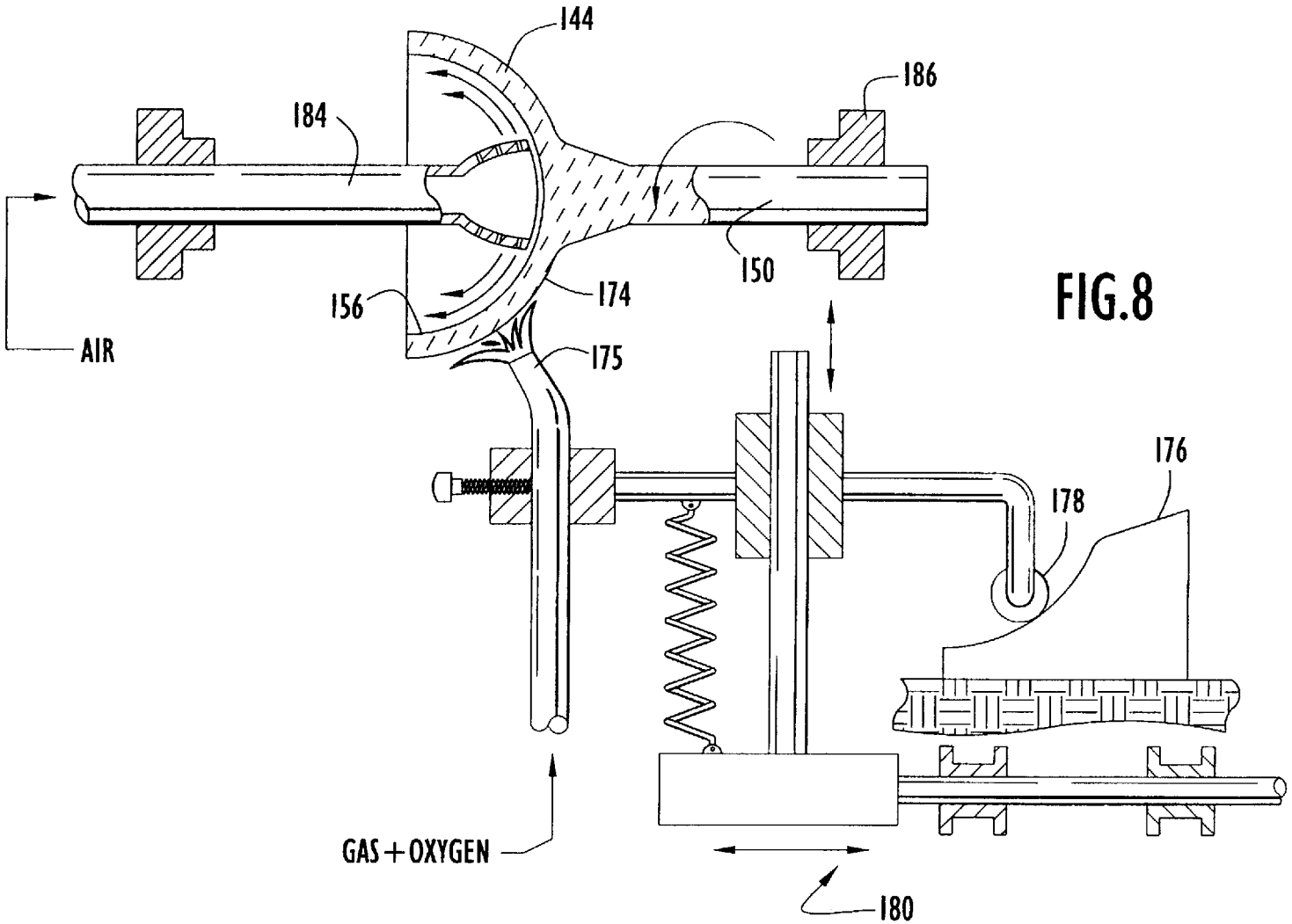
FIG. 8 is a schematic diagram of a method and apparatus for flame polishing the ceramic reflector of the present invention.

In the method for making the bulbs of the present invention, the ceramic reflecting segment 144 is cast, preferably from quartz ceramic. As illustrated in FIG. 8, ceramic reflector segment 144 has an outside surface 174 smoothed and sealed by fire polishing with torch 175. Torch 175 is movable and controlled to closely follow the contour of reflector segment outside surface 174 by operation of torch position control mechanism 180, including a template 176 (which corresponds to the shape of outside surface 174) and movable template follower 178 which is responsive to changes in the contour of template 176. Gas and oxygen are supplied to torch 175 to maintain the flame required for fire polishing; the size and temperature of the flame are controlled as a function of the flow of gas fuel and oxygen to the torch, as is well known in the art. In order to prevent cracking of ceramic reflective segment 144 during fire polishing, the reflector inside surface 156 is cooled with a gas jet from gas torch 184. Preferably, air is used as the cooling gas. During fire polishing, support stem 150 is supported in a rotatable chuck 186 and is rotated at a selected rotational velocity. Fire polishing is performed until such time as the outside surface of reflector segment 144 has fused, thereby eliminating any possibility of fill gas permeation through reflector segment 144.

Figure 9:
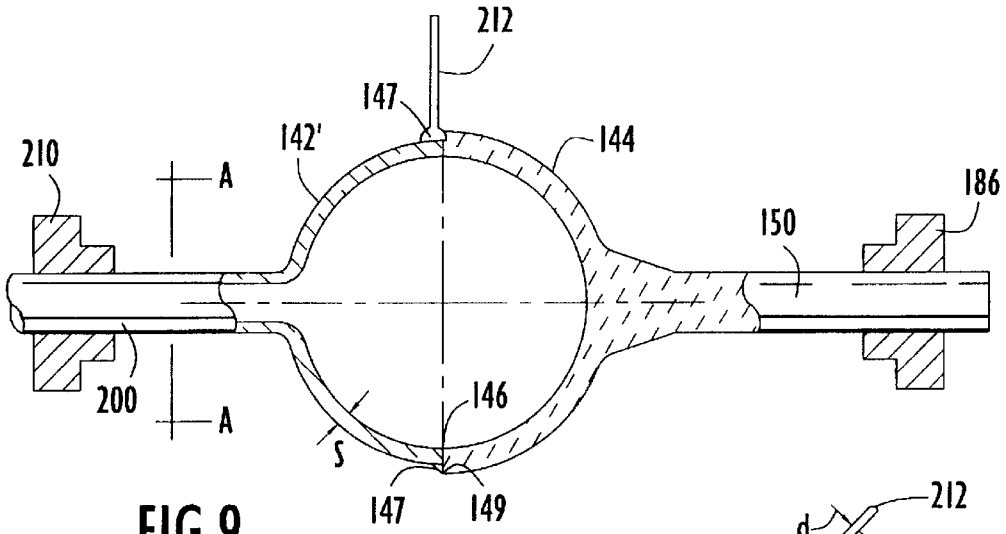
FIG. 9 is a diagrammatic view in partial cross-section of the fusing process of the method of manufacture of the bulb of the present invention.
Figure 10:
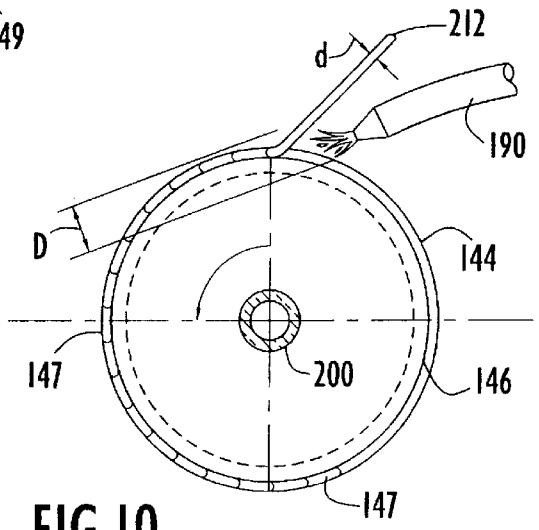
FIG. 10 is and end view, as viewed from the left, of the fusing process illustrated in FIG. 9.

Turning now to FIGS. 9 and 10, the first light transmissive segment 142' and second ceramic reflective segment 144 are integrated (i.e. made integral), preferably by fusing at seam or joint 146, preferably with a gas torch or laser 190 to enclose a volume defined by the two segments. FIG. 9 illustrates the fusing process from the side and FIG. 10 illustrates an end view, from the perspective of the plane corresponding to lines A—A. The first light transmissive segment 142' has a temporary support stem 200 mounted in a rotatable chuck 210 and is positioned axially aligned with and abutting the reflective segment 144 such that the first segment 142' and the second segment 144 are joined at and define seam 146 and a shoulder 149. Reflective segment 144 is supported by stem 150 and chuck 186. As can be seen from the cross-sectional view of FIG. 9, the first light transmissive segment 142 has a radial thickness S. As discussed above, the radial thickness S and outside diameter of first segment 142' are less than the radial thickness and outside diameter of second reflective segment 144 and so the shoulder 149 is formed at seam 146. In the preferred embodiment, light transmissive segment 142' and reflective segment 144 are fused together by adding fused silica material, preferably in the form of a solid silica rod 212 having a diameter less than or equal to 1.0 to 1.5 times the wall thickness S of clear quartz glass segment 142'. The fused silica material is applied in a fusion zone proximate the region of contact between the two segments. The fusion zone has a high temperature region or hot zone controlled to a diameter D of greater than or equal to about 2 times the wall thickness S, as illustrated in FIG. 10. The burner or torch 190 applies heat directly to the fusion zone and fused silica material is fed from rod 212 into the hot zone as the chucks 210 and 186 are rotated at identical rotational speed, thereby allowing a melted angled bead or fused bond to be created at joint or seam 146 and creating an enclosed or encapsulated volume 148 within what is to become envelope 140.

Using the method of the present invention, the advantageous bulb with integral reflector is produced. As noted above, the reflector segment may include heat sink elements. The outer surface of the bulb, including the heat sink elements, may be fire polished to fuse the outer surface into a gas impermeable state.

It will be appreciated that the embodiments described above and illustrated in the drawings represent only a few of the many ways of implementing the electrodeless lamp bulb having an integral ceramic reflector segment of the present invention. Alternative embodiments include other materials for use in the transparent segment or the reflective segment. For example, a reflective segment (e.g., 14) can be fabricated from silicon dioxide such as the high chemical purity synthetic silicon dioxide material sold under the trademark Kersil™ by the Kvartz firm of Leningrad, Russia. A reflective segment made of Kersil™ may have a fused surface, yielding greater density and reduced fluid permeability.

Having described preferred embodiments of a new and improved method and apparatus it is believed that other modifications, variations and changes will be suggested to those skilled in the art in view of the teachings set forth herein. For example, while the embodiments described herein illustrate a single ceramic reflective segment, two or more reflective ceramic segments may be joined to one or more light transmissive segments to provide a bulb with integral reflector according to the invention. Moreover, while the embodiments set forth herein all relate to electrodeless lamp bulbs, the teachings of the invention may also be applied to electroded lamps. It is therefore to be understood that all such variation, modifications and changes are believed to fall within the scope of the present invention.

What is claimed is:

1. A lamp bulb, comprising:

a light transmissive segment; and a reflective segment integrally joined with the light transmissive segment, wherein the light transmissive segment and reflective segment together define a pressure sealed interior volume of the lamp bulb, wherein the reflective segment comprises fused quartz ceramic, wherein the reflective segment includes an axial support extending therefrom.

2. A lamp bulb, comprising:

a light transmissive segment; and a reflective segment integrally joined with the light transmissive segment, wherein the light transmissive segment and reflective segment together define a pressure sealed interior volume of the lamp bulb, wherein the reflective segment comprises fused quartz ceramic, wherein the reflective segment includes a radial support extending therefrom.

3. A lamp bulb, comprising:

a light transmissive segment; and a reflective segment integrally joined with the light transmissive segment, wherein the light transmissive segment and reflective segment together define a pressure sealed interior volume of the lamp bulb, wherein the reflective segment has an inside surface and an outside surface and wherein the outside surface includes an integral heat sink element.

4. A lamp bulb, comprising:

a light transmissive segment; and a reflective segment integrally joined with the light transmissive segment, wherein the light transmissive segment and reflective segment together define a pressure sealed interior volume of the lamp bulb, wherein the light transmissive segment comprises a minor portion of a sphere, the reflective segment comprises a bowl-shaped portion having a circular open end, and wherein the light transmissive segment is joined to the circular open end of the reflective segment.

5. The lamp bulb as recited in claim 4, wherein the bowl-shaped portion has a generally parabolic cross section.

6. The lamp bulb as recited in claim 4, wherein the bowl-shaped portion has a generally U-shaped cross section.

7. The lamp bulb as recited in claim 4, wherein the bowl-shaped portion is a minor portion of a sphere.

8. A lamp bulb, comprising:

a light transmissive segment; and a reflective segment integrally joined with the light transmissive segment, wherein the light transmissive segment and reflective segment together define a pressure sealed interior volume of the lamp bulb, wherein the light transmissive segment comprises first and second light transmissive portions and wherein the reflective segment comprises a cylindrical member having a first open end and a second open end;

and wherein the first light transmissive portion is affixed to the first open end and the second light transmissive portion is affixed to the second open end.

9. The lamp bulb as recited in claim 8, wherein at least one of the first and second open ends is angled so that the cylindrical member does not form a right cylinder.

10. A lamp apparatus comprising the lamp bulb of claim 9, further including an external reflector disposed to receive and reflect light from the lamp bulb.

11. A lamp bulb, comprising:

a light transmissive segment; and a reflective segment integrally joined with the light transmissive segment, wherein the light transmissive segment and reflective segment together define a pressure sealed interior volume of the lamp bulb, wherein the light transmissive segment comprises a substantially hemispherical portion and the reflective segment comprises a mating substantially hemispherical portion, and wherein the interior volume defined thereby is substantially spherical.

12. The lamp bulb as recited in claim 11, wherein the light transmissive segment comprises a first wall and the reflective segment comprises a second wall, and wherein the second wall is radially thicker than the first wall.

13. A method for making a lamp bulb, the method comprising the steps of:

providing a light transmissive segment;

providing a reflective segment; and integrating the light transmissive segment and the reflective segment together to enclose a volume within the lamp bulb defined by the light transmissive segment and the reflective segment, wherein the step of providing the light transmissive segment comprises fusing silica into a desired shape adapted for affixation to the reflective segment.

14. A method for making a lamp bulb, the method comprising the steps of:

providing a light transmissive segment;

providing a reflective segment; and integrating the light transmissive segment and the reflective segment together to enclose a volume within the lamp bulb defined by the light transmissive segment and the reflective segment, wherein the step of providing the reflective segment comprises casting quartz ceramic into a desired shape adapted for affixation to the light transmissive segment.

15. The method of claim 14, wherein the step of providing the reflective segment further comprises fire polishing a surface of the cast quartz ceramic to fuse the ceramic surface and render the reflective segment impermeable to gas.

16. The method of claim 15, wherein the step of fire polishing comprises applying a high temperature flame to an outside surface of the cast ceramic reflective segment while applying a cooling flow of gas to an inside surface of the cast ceramic reflective segment.

17. A method for making a lamp bulb, the method comprising the steps of:

providing a light transmissive segment;

providing a reflective segment; and integrating the light transmissive segment and the reflective segment together to enclose a volume within the lamp bulb defined by the light transmissive segment and the reflective segment, wherein the integrating step comprises fusing the light transmissive segment to the reflective segment by exposing a region of contact between the light transmissive segment and the reflective segment to high temperature in a fusion zone proximate the region of contact, wherein the fusing step further comprises adding silica material to the fusion zone.

18. The method of claim 17, wherein the light transmissive segment has a wall thickness and wherein the silica is added from a solid rod having a diameter; the rod diameter being in the range of 1.0 to 1.5 times the wall thickness.

19. The method of claim 18, wherein the fusion zone has a selected hot zone radial thickness, the hot zone radial thickness being in the range of at least about 2.0 times the wall thickness.

20. The method of claim 17, wherein the fusing step further comprises exposing the fusion zone to one of laser energy and a flame from a gas torch.

* * * * *